US005578975A

United States Patent [19]

Kazama et al.

[11] Patent Number: 5,578,975

[45] **Date of Patent: *Nov. 26, 1996**

[54] COAXIAL DIELECTRIC FILTER HAVING ADJACENT RESONATORS DISPOSED IN OPPOSITE DIRECTIONS

[75] Inventors: Satoshi Kazama, Takasaki; Tatsuya Imaizumi, Gunma-ken, both of Japan

[73] Assignee: Taiyo Yuden Co., Ltd., Tokyo, Japan

[ * ] Notice: The term of this patent shall not extend beyond the expiration date of Pat. No. 5,412,359.

[21] Appl. No.: 337,277

[22] Filed: Nov. 10, 1994

Related U.S. Application Data

[63] Continuation of Ser. No. 85,318, Jun. 29, 1993, Pat. No. 5,412,359.

[30] Foreign Application Priority Data

Jun. 30, 1992 [JP] Japan ..... 4-197541

[51] Int. Cl.[6] ..... H01P 1/205

[52] U.S. Cl. ..... 333/202; 333/203; 333/206; 333/134

[58] Field of Search ..... 333/202, 203, 333/206, 207, 222, 223, 134

[56] References Cited

U.S. PATENT DOCUMENTS

| | | | |
|---|---|---|---|
| 4,703,291 | 10/1987 | Nishikawa et al. | 333/206 X |
| 5,144,269 | 9/1992 | Itoh | 333/206 |
| 5,304,967 | 4/1994 | Hayashi | 333/206 |
| 5,412,359 | 5/1995 | Kazama et al. | 333/134 X |

FOREIGN PATENT DOCUMENTS

| | | | |
|---|---|---|---|
| 0038601 | 2/1987 | Japan . | |
| 0125701 | 6/1987 | Japan . | |
| 0050102 | 3/1988 | Japan . | |
| 0278401 | 11/1988 | Japan . | |
| 0053601 | 3/1989 | Japan . | |
| 3292002 | 12/1991 | Japan | 333/202 DB |
| 0167701 | 6/1992 | Japan . | |

OTHER PUBLICATIONS

Nishikawa, T., "Radio Frequency Circuit Components", *Microwave Workshop Digest,* Sep. 17–19, 1991, pp. 75–80.

*Primary Examiner*—Benny Lee
*Attorney, Agent, or Firm*—Woodcock Washburn Kurtz Mackiewicz & Norris

[57] ABSTRACT

A wave filter having two or more dielectric resonators of substantially tubular shape juxtaposed on a base structure with their longitudinal orientations reversed alternately. The resonator terminals are therefore staggered on both sides of the juxtaposition of the resonators and thus better electrically isolated from one another than if all the resonators are oriented in the same longitudinal direction. The base structure is of ceramic material, having coupling elements, terminals, and all necessary electrical connections formed thereon or embedded therein.

27 Claims, 14 Drawing Sheets

COAXIAL DIELECTRIC FILTER HAVING ADJACENT RESONATORS DISPOSED IN OPPOSITE DIRECTIONS

This application is a continuation of application Ser. No. 08/085,318, filed Jun. 29, 1993, now U.S. Pat. No. 5,412, 359, issued May 2, 1995.

BACKGROUND OF THE INVENTION

This invention relates generally to wave filters, and particularly to radio frequency filters of the kind comprising two or more dielectric resonators. The radio frequency filters according to the invention lend themselves to use in mobile or portable telephone sets, among other applications.

Bandpass or bandstop radio frequency filters have been known which are each comprised of a juxtaposition of coaxial dielectric resonators operating in transverse electromagnetic (TEM) mode. Examples of such filters are disclosed in the article entitled "Radio Frequency Circuit Components" by Nishikawa in *Microwave Workshop Digest,* MWE '91. The coaxial dielectric resonators in such filters are coupled together via capacitors, strip transmission lines, transformers, or the like.

The current trend with such dielectric resonator wave filters, as with almost any other electric or electronic devices and appliances, is reduction in size. This trend inherently requires the juxtaposition of the coaxial dielectric resonators as close as possible. Conventionally, however, the closer the resonators were juxtaposed, the less were their terminals electrically isolated from one another. The result was the danger of the leakage of the frequencies that had to be attenuated, from the input side to the output side terminals. This phenomenon is due obviously to the aerial propagation of signals.

It might then be contemplated to provide the resonators within antileakage shields of one kind or another. This solution works to a certain extent, but too much reliance on such shields is objectionable because they not only make the complete apparatus heavy, bulky and costly but also set limits on the latitude of filter design in meeting various requirements of each specific application.

The same problem existed with filter systems each comprising a required number of dielectric resonators mounted on a common base structure to make up two or more filter units. Signal leakage was easy to occur in this case from one filter unit to another wherever the resonators were closely juxtaposed.

SUMMARY OF THE INVENTION

The present invention seeks to electrically isolate the juxtaposed dielectric resonators of a radio frequency filter against signal leakage, thereby making possible its size reduction without in any way sacrificing its performance.

Briefly, the invention may be summarized as a wave filter apparatus having at least two dielectric resonators. Each dielectric resonator comprises a dielectric body substantially in the shape of an elongate tube, an inner conductor formed on the inside surface of the dielectric body, an outer conductor formed on the outside surface of the dielectric body, a shorting conductor formed on one end of the dielectric body for electrically interconnecting the inner and the outer conductors, and a terminal formed on another end of the dielectric body and electrically connected to the inner conductor. The dielectric resonators are disposed side by side and oriented in opposite longitudinal directions.

Thus the terminals of the dielectric resonators are staggered on the opposite sides of the juxtaposed resonators and consequently spaced from each other a greater distance than if the resonators are oriented in the same longitudinal direction. The staggered arrangement of the resonator terminals makes it possible to juxtapose the resonators with no or minimum spacing therebetween without fear of signal leakage. Resonator isolation is so much improved according to the invention that antileakage shields may be dispensed with in some cases for the reduction of both size and cost.

Preferably, for the provision of an even more compact wave filter, the dielectric resonators may be mounted as above on a base structure comprised of a ceramic base plate or of a lamination of such base plates. Capacitors or other coupling elements, terminals, and all necessary electrical connections can be formed on, or embedded in, the base structure.

The above and other features and advantages of this invention and the manner of realizing them will become more apparent, and the invention itself will best be understood, from a study of the following description and appended claims, with reference had to the attached drawings showing some preferable embodiments of the invention.

DESCRIPTION OF THE PREFERRED EMBODIMENTS

Figure 1:
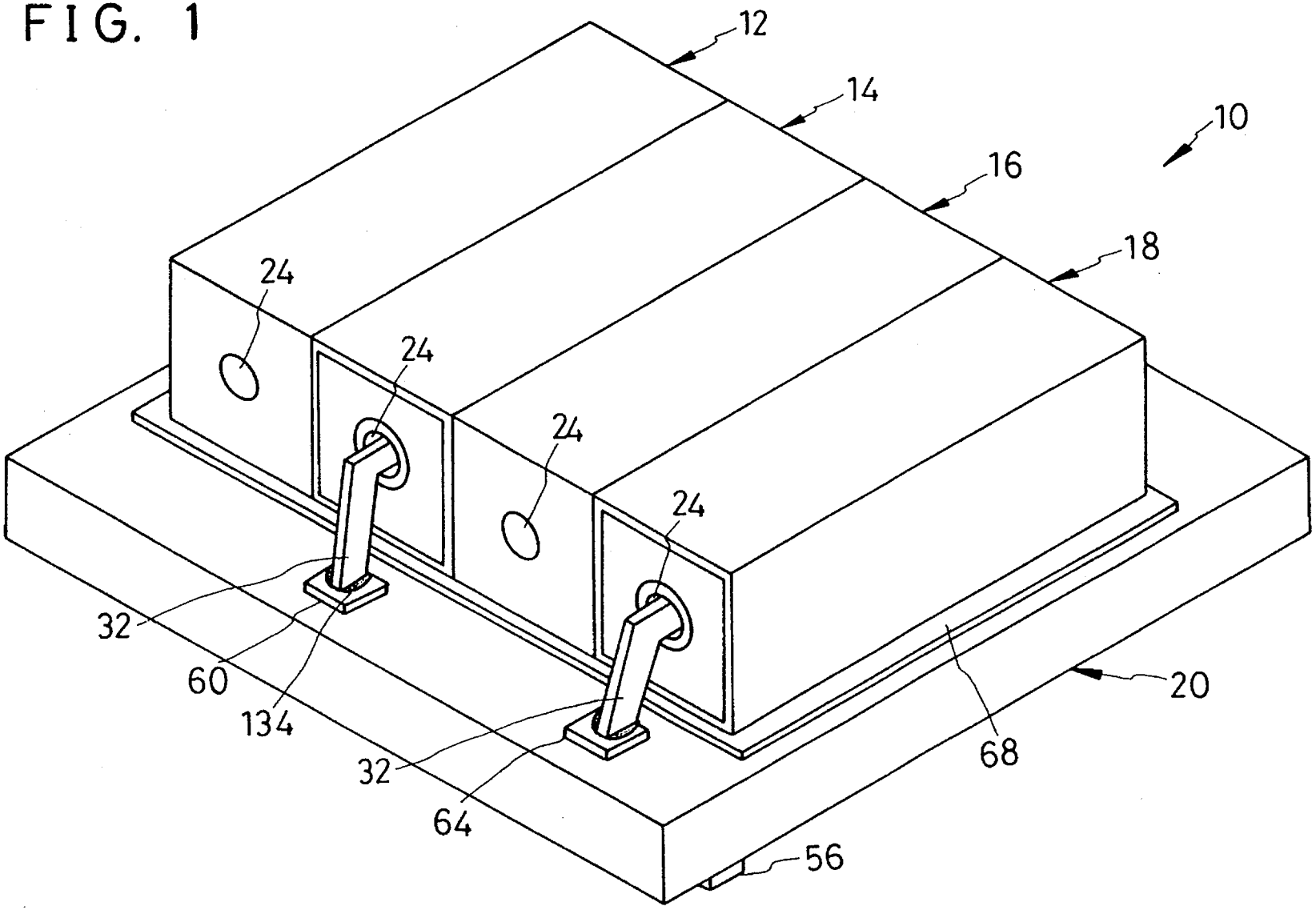
FIG. 1 is a perspective view of a radio frequency bandpass filter constructed in accordance with the novel concepts of this invention.

The invention will now be described in detail as embodied in a Chebyschev bandpass filter incorporating TEM mode coaxial dielectric resonators. Generally designated 10 in FIGS. 1 and 2, the Chebyschev filter comprises a plurality of, four in this particular embodiment, dielectric resonators 12, 14, 16 and 18 juxtaposed on a base structure 20. The four resonators 12–18 are all of identical make. Only one of these resonators will therefore be described in detail, and various parts of the other resonators will be identified by the same reference numerals as used to describe the corresponding parts of the representative resonator.

Figure 3:
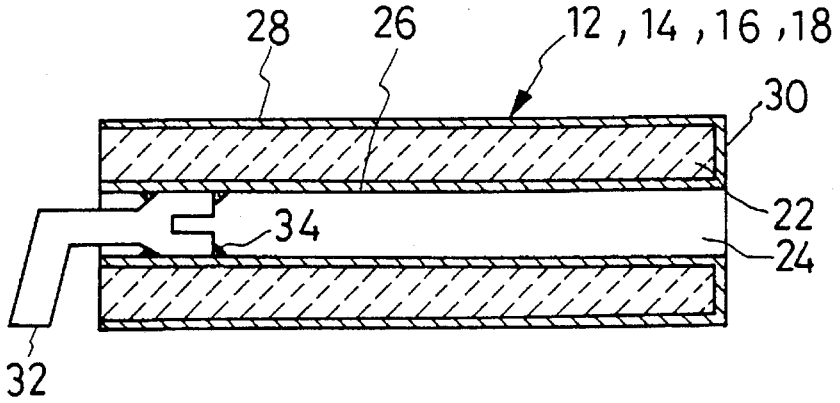
FIG. 3 is a longitudinal section through each dielectric resonator of the FIG. 1 filter.
Figure 4:
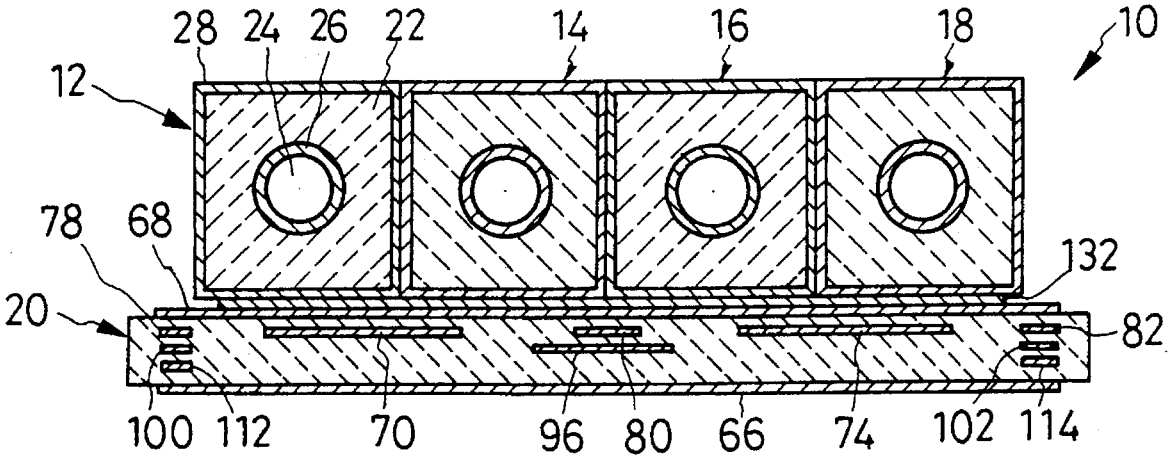
FIG. 4 is a section taken along the line IV—IV in FIG. 2.

As will be understood from FIG. 3, taken together with FIG. 4, the representative dielectric resonator illustrated therein has a dielectric body 22 of substantially tubular shape, preferably square in cross sectional shape, which is fabricated from a ceramic material with a specific dielectric constant of 88. The length of the dielectric body 22 is a quarter of the fundamental wavelength. A resonance hole 24 extends longitudinally and centrally through the dielectric body 22. An inner conductor 26 covers the surface of the resonance hole 24 whereas an outer conductor 28 covers the outer surface of the dielectric body 22. A shorting conductor 30 covers one annular end surface of the dielectric body 22 and thus electrically interconnects the inner 26 and outer 28 conductors. All these conductors 26, 28 and 30 may be formed by coating a silver paste on the required surfaces of the dielectric body 22 and by baking the coatings.

Inserted in the resonance hole 24 through the other end thereof is a metal made terminal 32 which is soldered at 34 to the inner conductor 26. The terminal 32 partly projects out of the resonance hole 24 and is angled downwardly for connection to the base structure 20.

Figure 2:
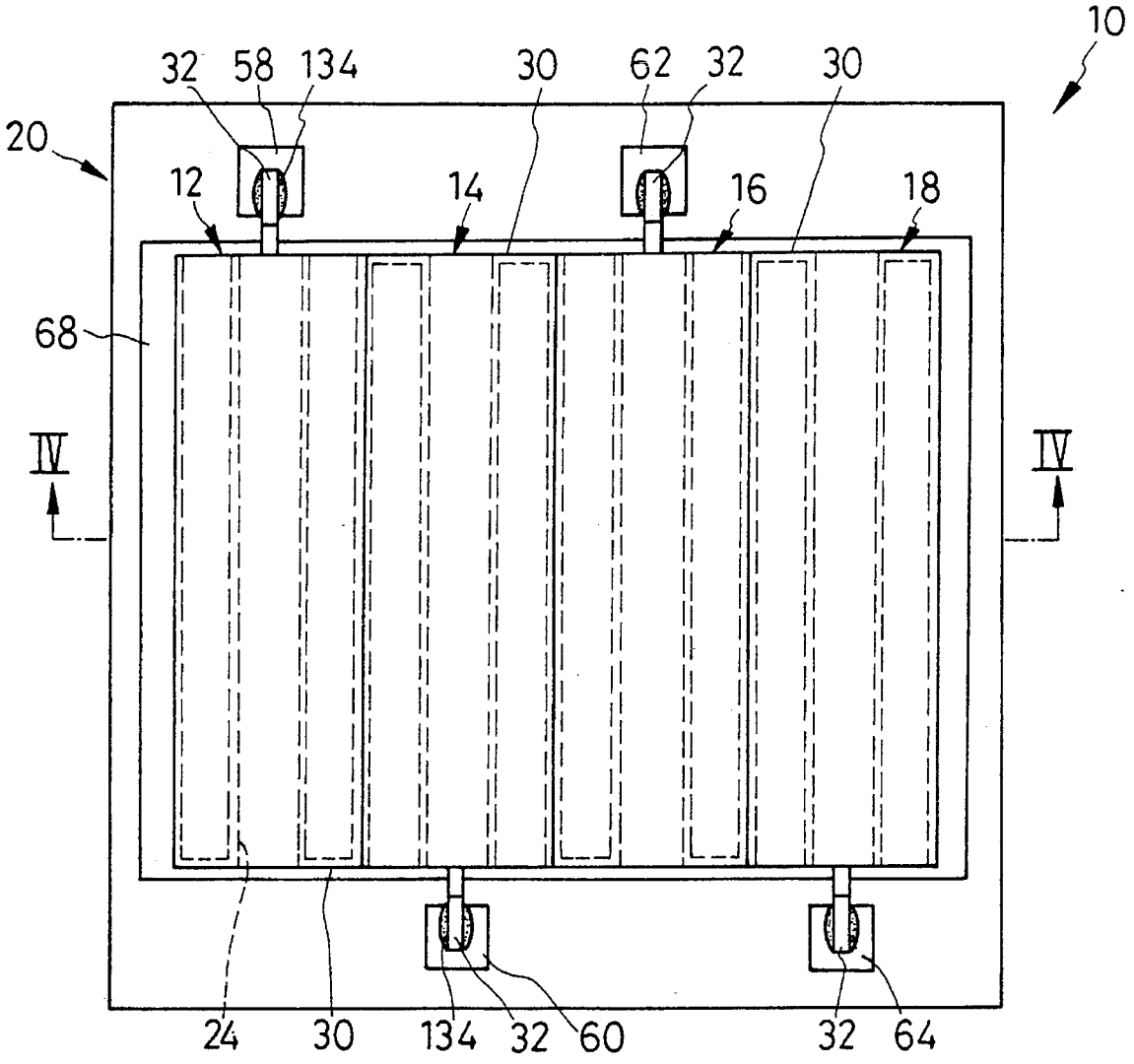
FIG. 2 is a top plan of the FIG. 1 filter.

It will be noted from FIGS. 1 and 2 that the four dielectric resonators 12–18 are alternately arranged in opposite longitudinal directions according to a feature of this invention. Thus, as best seen in FIG. 2, the resonator terminals 32 are staggered on the opposite sides of the juxtaposed resonators, with the first and third resonator terminals disposed on one side of the resonators and the second and fourth resonator terminals on the other side.

Figure 5:
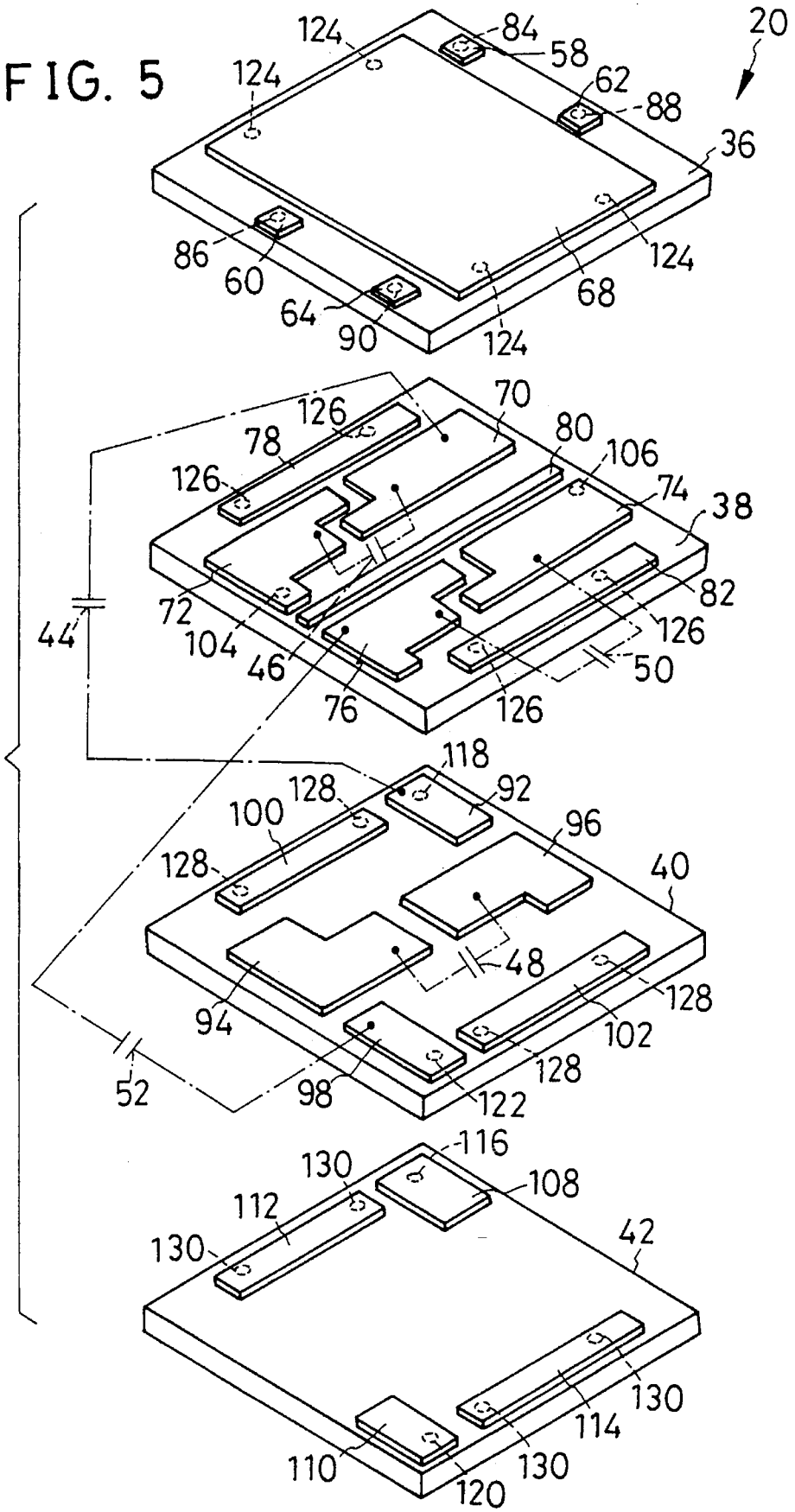
FIG. 5 is an exploded perspective view of the base structure of the FIG. 1 filter.
Figure 6:
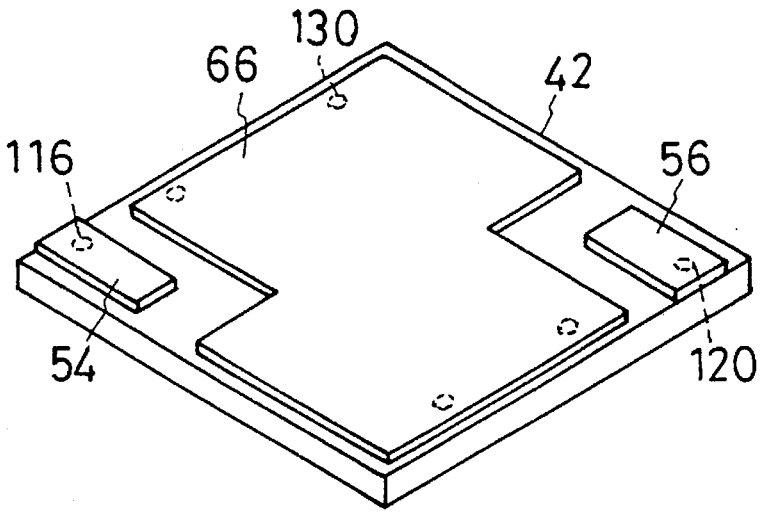
FIG. 6 is a perspective view of the lowermost base plate of the FIG. 5 base structure.

FIGS. 5 and 6 are detailed illustrations of the base structure 20 of the wave filter 10. The base structure 20 is therein shown as a lamination of four base plates 36, 38, 40 and 42 of ceramic material. Thin conductor regions of various shapes and sizes are formed on the surfaces of the base plates 36–42 to provide coupling capacitors and other means needed for the functioning of the wave filter 10.

Figure 7:
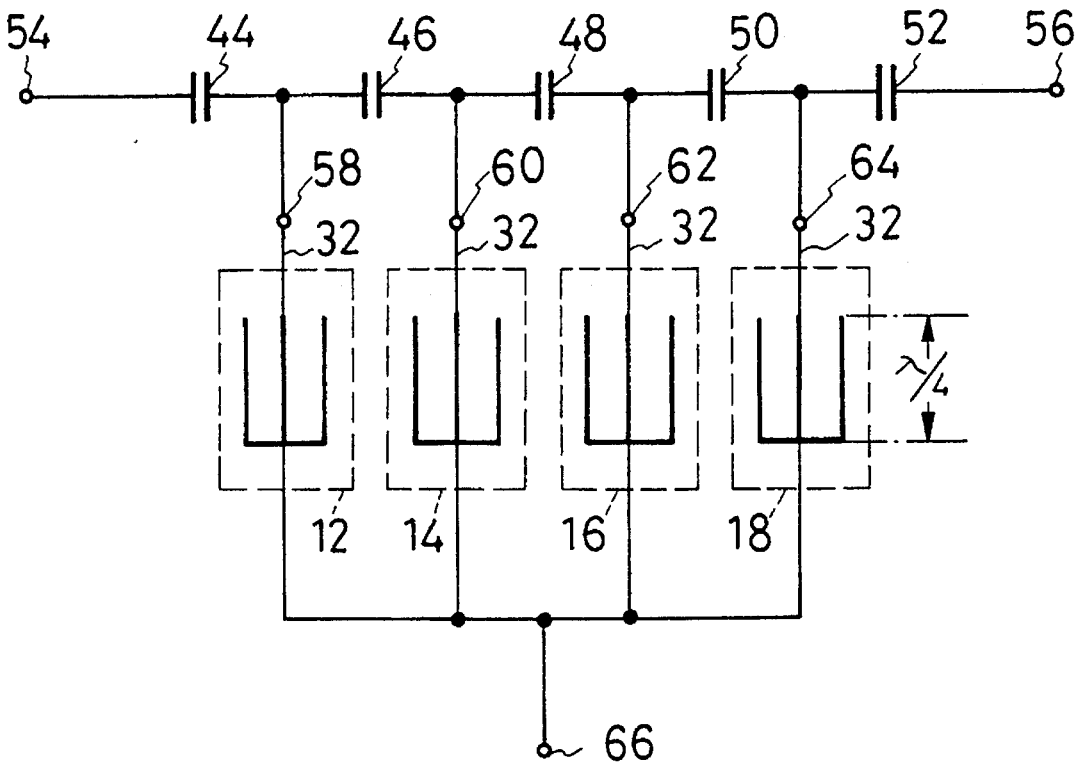
FIG. 7 is a schematic electrical diagram of the equivalent circuit of the FIG. 1 filter.

The construction of the base structure 20 will be better understood by first studying the equivalent circuit of the Chebyschev bandpass filter 10 illustrated in FIG. 7. It will be seen from this equivalent circuit diagram that, essentially, the filter 10 comprises the noted four dielectric resonators 12–18 and five coupling capacitors 44, 46, 48, 50 and 52. The first capacitor 44 is connected between the input terminal 54 of the filter and the terminal 32 of the first resonator 12, the second capacitor 46 between the terminals 32 of the first 12 and second 14 resonators, the third capacitor 48 between the terminals 32 of the second 14 and third 16 resonators, the fourth capacitor 50 between the terminals 32 of the third 16 and fourth 18 resonators, and the fifth capacitor 52 between the terminal 32 of the fourth resonator 18 and the output terminal 56 of the filter. The resonator terminals 32 are coupled directly to the terminals 58, 60, 62 and 64, respectively, of the base structure 20 and thence to the capacitors 44–52 as above. Also, the outer conductors 28 of all the resonators 12–18 are connected to a grounding terminal 66. The terminals 58–64 of the base structure 20 will be hereinafter referred to as the base terminals in contradistinction from the resonator terminals 32.

The first 44 and fifth 52 capacitors are equal in capacitance, and so are the second 46 and fourth 50 capacitors. The third capacitor 48 is less in capacitance than the second 46 and fourth 50 capacitors, and these second and fourth capacitors are less in capacitance than the first 44 and fifth 52 capacitors.

The capacitors 44–52 and terminals 54–66 shown in FIG. 7, as well as electrical connections among them, are all built into the base structure 20 shown in FIGS. 5 and 6. This base structure is composed as aforesaid of the four ceramic base plates 36–42. The various conductor regions formed on these base plates will now be described in the order of the topmost base plate 36 down to the lowermost base plate 42.

The topmost or first base plate 36, on which the four dielectric resonators 12–18 are to be mounted, has formed on its top surface a grounding conductor region 68, which occupies most of the area of this surface, and four much smaller conductor regions 58, 60, 62 and 64. These smaller conductor regions 58–64 correspond to the base terminals designated by the same reference numerals in the FIG. 7 equivalent circuit, so that they will be hereinafter referred to as the base terminal conductor regions. Being intended for direct coupling to the resonator terminals 32, the base terminal conductor regions 58–64 are disposed on both sides of the grounding conductor region 68 in staggered arrangement, with the base terminal conductor regions 58 and 62 for the first 12 and third 16 dielectric resonators on one side of the region 68, and the base terminal conductor regions 60 and 64 for the second 14 and fourth 16 dielectric resonators on the other side of the region 68.

The second base plate 38 has formed on its top surface four capacitor conductor regions 70, 72, 74 and 76 and three grounding conductor regions 78, 80 and 82. Disposed adjacent each other, the capacitor conductor regions 70 and 72 constitute the second capacitor 46. These capacitor conductor regions 70 and 72 are disposed in register with the base terminal conductor regions 58 and 60, respectively, on the first base plate 36 and electrically connected thereto via conductors, not shown, filled in holes 84 and 86 extending through the first base plate. The conductors within these and other holes in the first and other base plates may be of the same material as the various conductor regions on the base plates 36–42 and formed simultaneously therewith. All such holes filled with conductors will be hereinafter referred to as conductor holes.

The other two adjoining capacitor conductor regions 74 and 76 on the second base plate 38 constitute the fourth capacitor 50. The capacitor conductor region 74 is electrically connected to the base terminal conductor region 64 on the first base plate 36 via a conductor hole 88 therein, and the other capacitor conductor region 76 to the base terminal conductor region 64 on the first base plate 36 via a conductor hole 90 therein.

The third base plate 40 has formed on its top surface four capacitor conductor regions 92, 94, 96 and 98 and two grounding conductor regions 100 and 102. Opposed to each other across the second base plate 38, the capacitor conductor region 92 on the third base plate 38 and the capacitor conductor region 70 on the second base plate 38 constitute the first capacitor 44. The capacitor conductor regions 94 and 96 constitute the third capacitor 48. The capacitor conductor region 94 is electrically connected to the capacitor conductor region 72 on the second base plate 38 via a conductor hole 104 therein, and the other capacitor conductor region 96 is electrically connected to the capacitor conductor region 74 on the second base plate 38 via a conductor hole 106 therein. Also, opposed to the capacitor conductor region 76 on the second base plate 38 across this second base plate, the capacitor conductor region 98 on the third base plate 38 constitutes the fifth capacitor 52 in combination with the capacitor conductor region 76.

The fourth or lowermost base plate 42 has formed on its top surface two terminal conductor regions 108 and 110 and two grounding conductor regions 112 and 114. Further, as illustrated in FIG. 6, the lowermost base plate 42 has formed on its bottom surface two terminal conductor regions 54 and 56 and a grounding conductor region 66. The terminal conductor region 54 corresponds to the filter input terminal 54 in the FIG. 7 equivalent circuit, the other terminal conductor region 56 to the filter output terminal 56, and the grounding conductor region 66 to the grounding terminal 66.

A reference to FIG. 7 will reveal that filter input terminal 54 is connected to the first capacitor 44, and the filter output terminal 56 to the fifth capacitor 52. For these connections, as will be understood by referring to FIGS. 5 and 6 again, the filter input terminal conductor region 54 on the bottom surface of the lowermost base plate 42 is electrically connected to the terminal conductor region 108 on the top surface of the lowermost base plate via a conductor hole 116 therein and thence to the first capacitor conductor region 92 on the third base plate 40 via a conductor hole 118 therein. The filter output terminal conductor region 56 on the bottom surface of the lowermost base plate 42 is electrically connected to the terminal conductor region 110 on the top surface of the lowermost base plate via a conductor hole 120 therein and thence to the fifth capacitor conductor region 98 on the third base plate 40 via a conductor hole 122 therein.

FIG. 7 also indicates that the conductors of the four dielectric resonators 12–18 are all electrically coupled to the grounding terminal 66. For this purpose the grounding conductor region 68 on the topmost base plate 36 is electrically connected to the grounding terminal conductor region 66 on the bottom surface of the lowermost base plate 42 via conductor holes 124 in the topmost base plate 36, conductor holes 126 in the second base plate 38, holes 128 in the third base plate 40, and conductor holes 130 in the lowermost base plate 42.

For the fabrication of the base structure 20 of the foregoing construction, there may first be prepared green or unsintered ceramic sheets of rectangular shape, preferably composed principally of alumina. After creating holes in the required positions through these green ceramic sheets, a silver paste may be coated their surfaces in the various required conductor patterns. Then the ceramic sheets may be stacked up, pressed together, and cosintered with the silver coatings.

Next comes the step of mounting the dielectric resonators 12–18 on the base structure 20. The resonators 12–18 may be placed in close juxtaposition and in the required directions on the top of the base structure 20, in such a way that the projecting ends of the resonator terminals 32 come into register with the base terminals 58–64. Then the outer conductors 28 of the resonators 12–18 may be soldered at 132, FIG. 4, to the grounding conductor region 68 of the base structure 20, and the resonator terminals 32 soldered at 134, FIGS. 1 and 2, to the base terminals 58–64.

Figure 8:
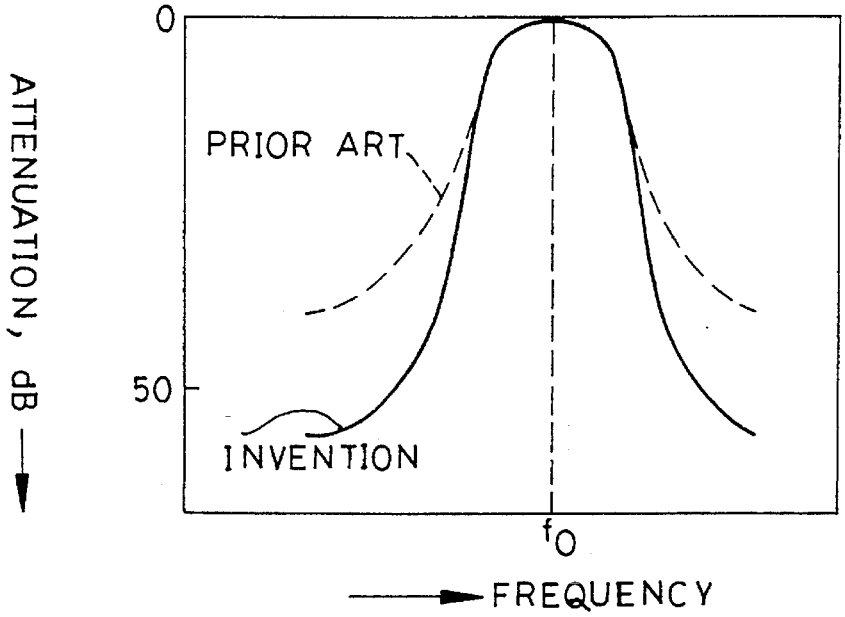
FIG. 8 is a graphic representation of the frequency characteristic of the FIG. 1 filter, shown in comparison with that of a comparable prior art filter.

The solid line curve in the graph of FIG. 8 represents the frequency characteristic of the bandpass filter 10 of the FIGS. 1–7 construction. The dashed curve in the same graph represents the frequency characteristic of the prior art filter which is similar in construction to the filter 10 except the four dielectric resonators are oriented in the same direction. Both the filter 10 according to the invention and the prior art filter were not shield by antileakage housings or other comparable means.

It will be appreciated that the bandpass filter 10 according to the invention attenuates frequency components outside the pass band, having the central frequency $f_o$, far more sharply than does the prior art filter. Equipped with optimum antileakage means, however, the prior art filter has proved to gain the same frequency characteristic as that of the filter 10 according to the invention. This means that, even without antileakage means, the filter 10 is just as favorable in performance as the prior art filter having antileakage means and, if provided with antileakage means, much better than the prior art.

The sharp attenuation of frequency components outside the pass band according to the invention is due obviously to the arrangement of the dielectric resonators 12–18 in alternately opposite directions. Such alternating arrangement makes longer the spacings between the resonator terminals 32, between the base structure terminals 58–64, and between the terminals of the input side resonator 12 and output side resonator 18, thereby reducing the leakage of undesired frequency components between all these terminals.

The alternating arrangement of the dielectric resonators 12–18 according to the invention demands special consideration in the arrangement of the coupling capacitors 44–52. Should these capacitors be disposed in one and the same plane on or within the base structure, they would make the base structure inconveniently bulky, offsetting the compact arrangement of the dielectric resonators thereon. This inconvenience is overcome by employing a laminar construction for the base structure 20 and by embedding the coupling capacitors 44–52 in different planes therein. It will also be appreciated that the conductor layers of the capacitors 44–52 are to be hardly affected by external noise because the ceramic body of the base structure 20 is sandwiched between the large grounding conductor regions 66 and 68.

Second Form

Figure 11:
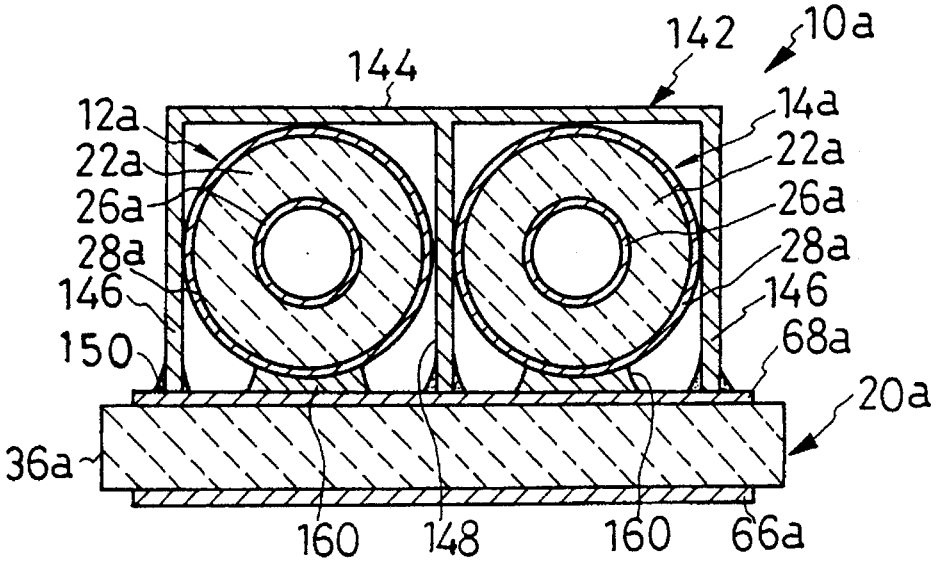
FIG. 11 is a section taken along the line XI—XI in FIG. 10.
Figure 12:
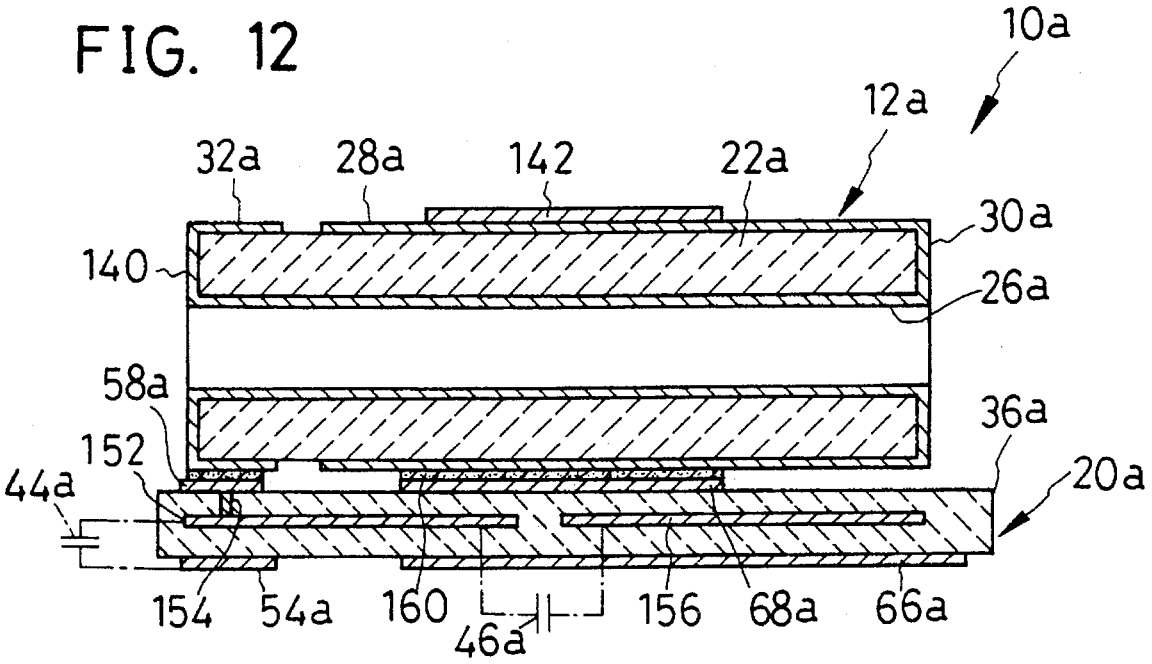
FIG. 12 is a section taken along the line XII—XII in FIG, 10.
Figure 13:
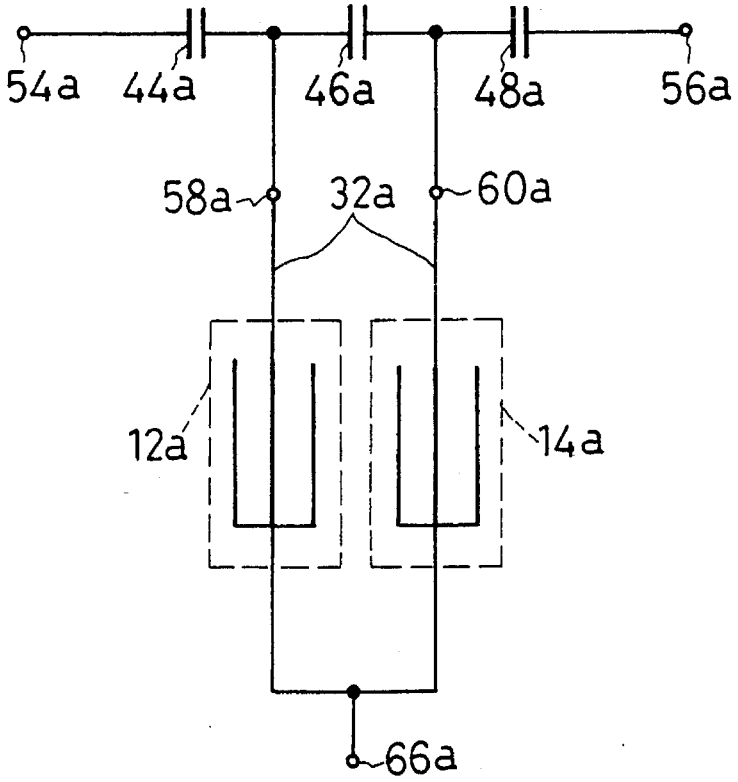
FIG. 13 is a schematic electrical diagram of the equivalent circuit of the FIG. 9 filter.

FIGS. 9–12 illustrate another preferred form of bandpass filter **10*a* according to the invention, and FIG. 13 shows the equivalent circuit of this filter. The bandpass filter 10*a* has but two dielectric resonators 12*a* and 14*a* mounted side by side and arranged in opposite directions on a base structure 20*a*. The two resonators 12*a* and 14*a*** are identical in construction.

As will be best understood from FIGS. 11 and 12, each of the dielectric resonators **12*a* and 14*a* comprises a dielectric body 22***a* of tubular shape, an inner conductor 26*a* covering the entire inside surface of the tubular body 22*a*, an outer conductor 28*a* covering most part of the outside surface of the tubular body, and a shorting conductor 30*a* formed on one end of the tubular body for electrically interconnecting the inner and outer conductors.

It will be also noted from FIG. 12 that the inner conductor 26*a* of each dielectric resonator has an extension 140 on the other end of the tubular body 22*a* and is electrically connected therethrough to a terminal conductor 32*a* which is formed on part of that part of the outside surface of the tubular body which is left uncovered by the outer conductor 28*a*. The terminal conductor 32*a* is intended for electrical connection of the inner conductor 26*a* to coupling capacitors built into the base structure 20*a*, as will be detailed subsequently. Thus the terminal conductors 32*a* of the dielectric resonators 12*a* and 14*a* replace the unitary resonator terminals 32 of the FIGS. 1–8 filter 10, contributing to the greater ease of manufacture of the filter 10*a*.

Figure 9:
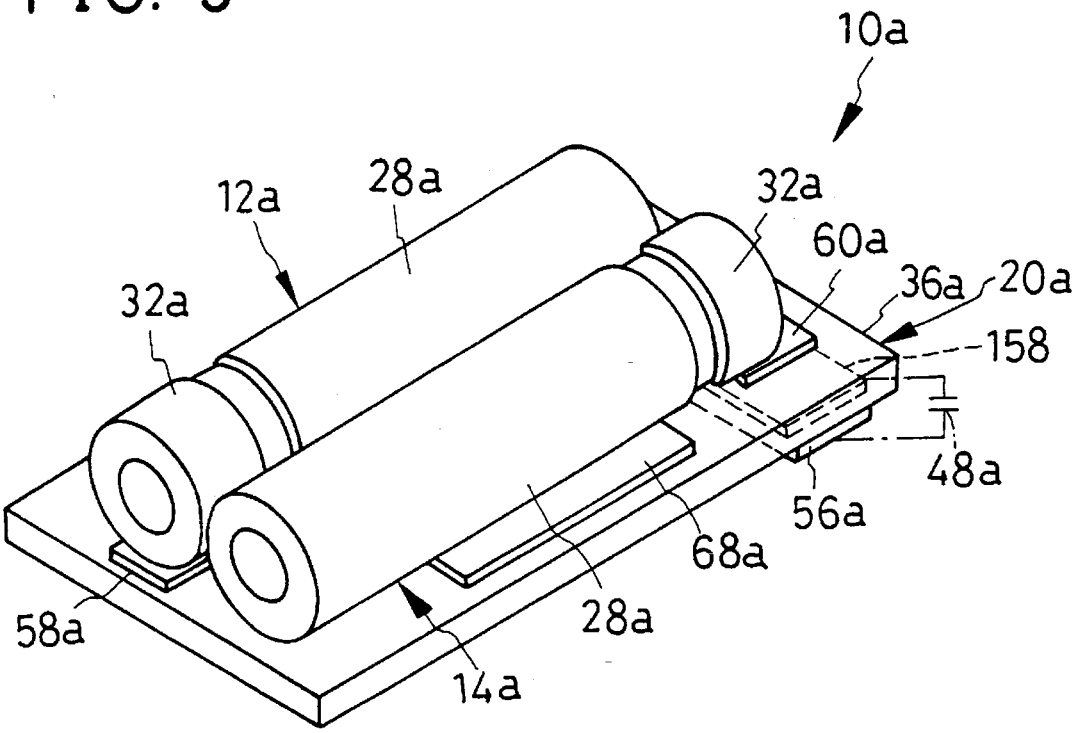
FIG. 9 is a perspective view of another preferred form of bandpass filter according to the invention.
Figure 10:
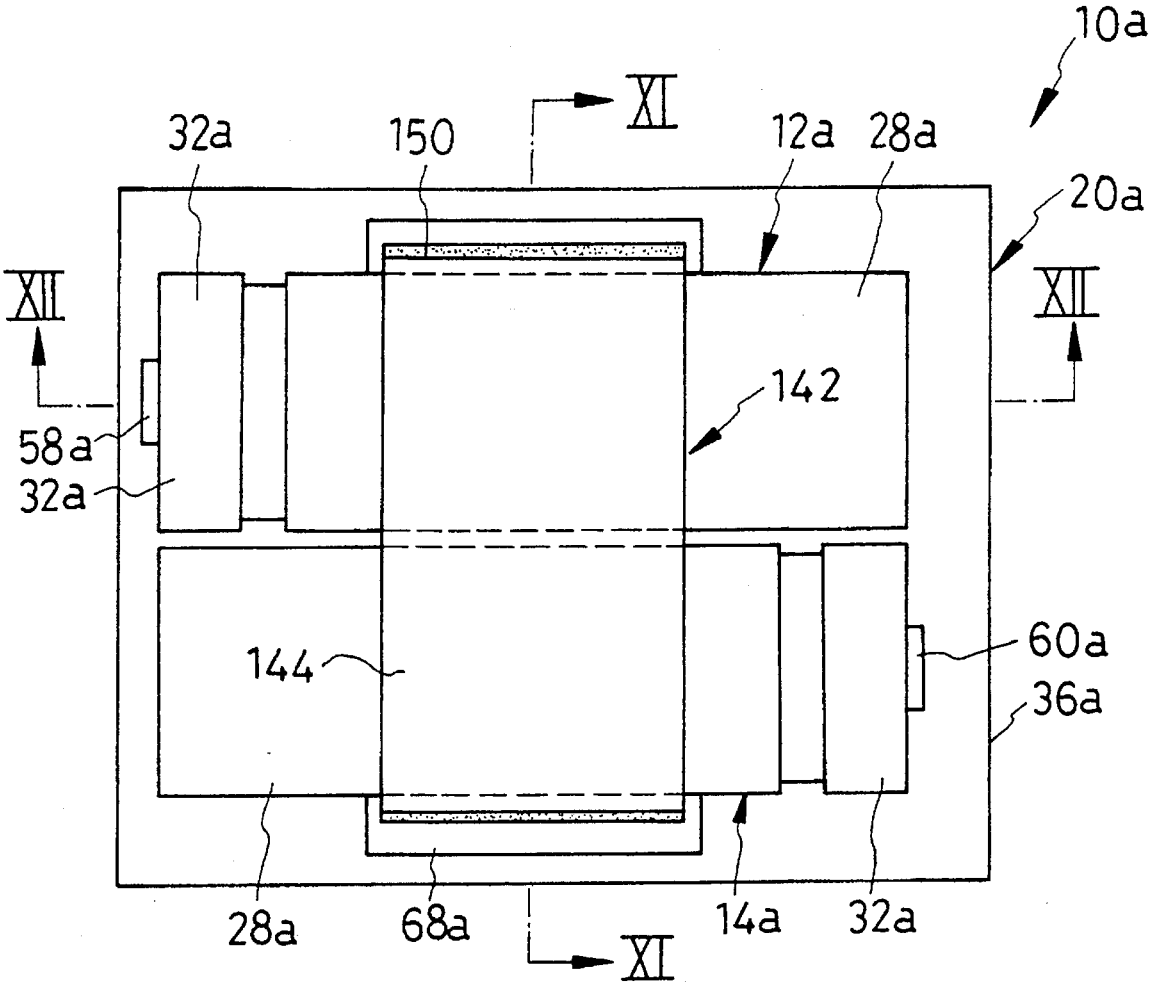
FIG. 10 is a top plan of the FIG. 9 filter, the filter being herein shown complete with a shield/clamp unit.

Another feature of the filter 10*a* resides in a combined antileakage shield and clamp unit 142 shown in FIGS. 10–12 but not in FIG. 9, this latter figure being intended to thoroughly reveal the two dielectric resonators 12*a* and 14*a*. Made from sheet metal, the shield/clamp unit 142 is in the shape of a recumbent E as seen in cross section as in FIG. 11, comprising a web 144, two outer flanges 146 depending from the opposite sides of the web, and a middle flange 148 depending from the middle of the web. The shield/clamp unit 142 has its three flanges 146 and 148 soldered at 150 to a grounding conductor region 68*a* of the base structure 20*a*, closely receiving the two dielectric resonators 12*a* and 14*a* in the two spaces bounded by the shield/clamp unit and the base structure and thus clamping the resonators to the base structure.

FIGS. 10 and 12 clearly indicates that the dimension of the shield/clamp unit 142 in the longitudinal direction of the dielectric resonators 12*a* and 14*a* is much less than the length of each resonator. Further the shield/clamp unit 142 clamps the midportions of the resonators 12*a* and 14*a*. Thus, intruding between the two resonators, the middle flange 148 of the shield/clamp unit 142 serves as a spacer preventing the outer conductor 28*a* of each resonator from contacting the terminal conductor 32*a* of the other resonator. Although the outer conductors 28*a* of the two resonators contact each other through the middle flange 148, this presents no problem at all because the outer conductors are meant to be grounded.

In this second embodiment, too, let us first examine the equivalent circuit of FIG. 13 before studying the construction of the base structure 20*a*. The two dielectric resonators 12*a* and 14*a* have their inside conductors connected to base terminals 58*a* and 60*a*, respectively, via the resonator terminal conductors 32*a*, and their outer conductors to a grounding terminal 66*a*. Since this filter 10*a* has but two dielectric resonators 12*a* and 14*a*, three coupling capacitors 44*a*, 46*a* and 48*a* are provided. The first capacitor 44*a* is connected between filter input terminal 54*a* and first base terminal 58*a*, the second capacitor 46*a* between first 58*a* and second 60*a* base terminals, and the third capacitor 48*a* between second base terminal 60*a* and filter output terminal 56*a*. The coupling capacitors 44*a*–48*a* and terminals 54*a*–60*a* are all built into the base structure 20*a*.

The three coupling capacitors 44*a*–48*a* required by the filter 10*a* makes it possible for the base plate 36*a* of the base structure 20*a* to be fabricated from two ceramic sheets in the manner set forth in connection with the FIGS. 1–8 filter 10.

As indicated in FIG. 12, the first capacitor 44*a* is constituted of the terminal conductor region 54*a* on the bottom surface of the base plate 36*a* and a capacitor conductor region 152 buried therein. This capacitor conductor region 152 is electrically connected to a base terminal conductor region 58*a* on the top surface of the base plate 36*a* through a conductor hole 154. The base terminal conductor region 58*a* makes direct contact with the terminal conductor 32*a* of the first resonator 12*a*.

As shown also in FIG. 12, the second capacitor 46*a* is constituted of the noted capacitor conductor region 152 and another capacitor conductor region 156 which is also buried in the base plate 36*a*. The capacitor conductor region 156 is electrically connected to a base terminal conductor region 60*a*, FIG. 9, on the top surface of the base plate 36*a* via a conductor hole, not shown. The base terminal conductor region 60*a* makes direct contact with the terminal conductor 32*a* of the second resonator 14*a*.

FIG. 9 further indicates that the third capacitor 48*a* is constituted of an extension 158 of the capacitor conductor region 156 and the filter output terminal conductor region 56*a* on the bottom surface of the base plate 36*a*. The outer conductors 28*a* of the two resonators 12*a* and 14*a* are both soldered at 160, FIGS. 11 and 12, to the grounding conductor region 68*a* on the top surface of the base plate 36*a*. The grounding conductor region 68*a* is electrically connected in turn to the grounding conductor region 66*a* on the bottom surface of the base plate 36*a* via a conductor hole or holes, not shown.

Thus, in this wave filter 10*a*, the terminal conductors 32*a* of the two dielectric resonators 12*a* and 14*a* are spaced from each other, and so are the base terminal conductor regions 58*a* and 60*a* on the top surface of the base plate 36*a* and the terminal conductor regions 54*a* and 56*a* on the bottom surface of the base plate, far more greatly than if the resonators are oriented in the same direction, as has been the case heretofore. The two resonators 12*a* and 14*a* are therefore electrically well isolated from each other even though they are juxtaposed with a minimal spacing therebetween.

Third Form

Figure 14:
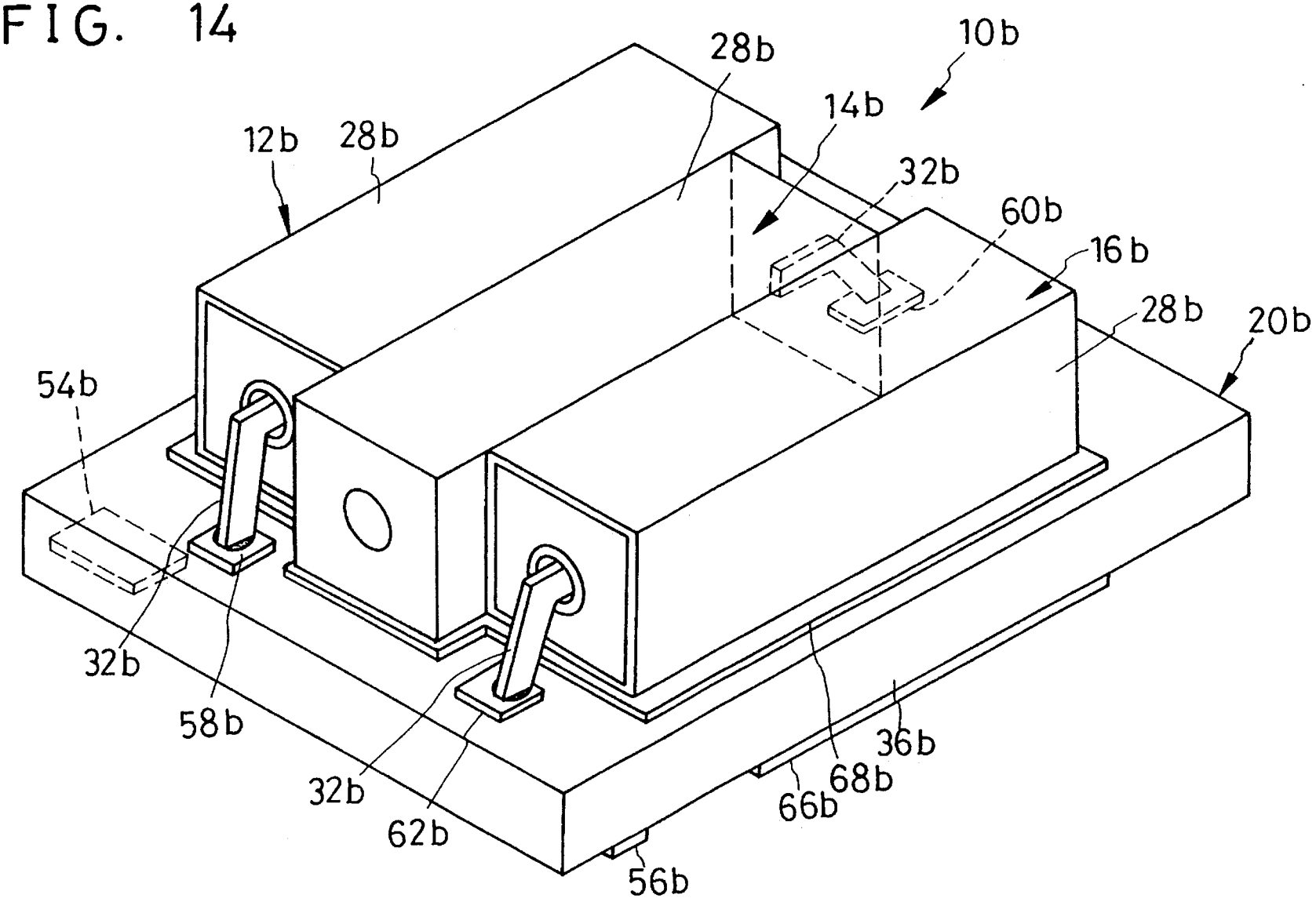
FIG. 14 is a perspective view of a bandstop filter constructed in accordance with the novel concepts of the invention.

In FIG. 14 is shown a bandstop filter 10*b* by way of still another preferred embodiment of the invention. This filter 10*b* employs three dielectric resonators 12*b*, 14*b* and 16*b* which are each identical in construction with the resonators 12–18 of the FIGS. 1–8 filter 10. The filter 10*b* is also akin to the filter 10 in that the three resonators 12*b*–16*b* are mounted on a base structure 20*b* in close juxtaposition and in alternately opposite directions, with the first 12*b* and third 16*b* resonators oriented in the same direction and with the second resonator 14*b* oriented in the opposite direction.

However, unlike the resonators 12–18 of the filter 10, the resonators 12*b*–16*b* of this filter 10*b* are not in transverse alignment; that is, they are alternately longitudinally displaced the same distance in opposite directions in such a way that, in this particular embodiment, the body of the second resonator 14*b* intrudes between the terminals 32*b* of the first 12*b* and third 16*b* resonators, which are in transverse alignment. This arrangement makes less the area on the base structure 20*b* required for installation of the resonators 12*b*–16*b*, and hence the size of the base structure and therefore of the complete filter 10*b*, than if the resonators are in transverse alignment as in the filter 10.

Figure 15:
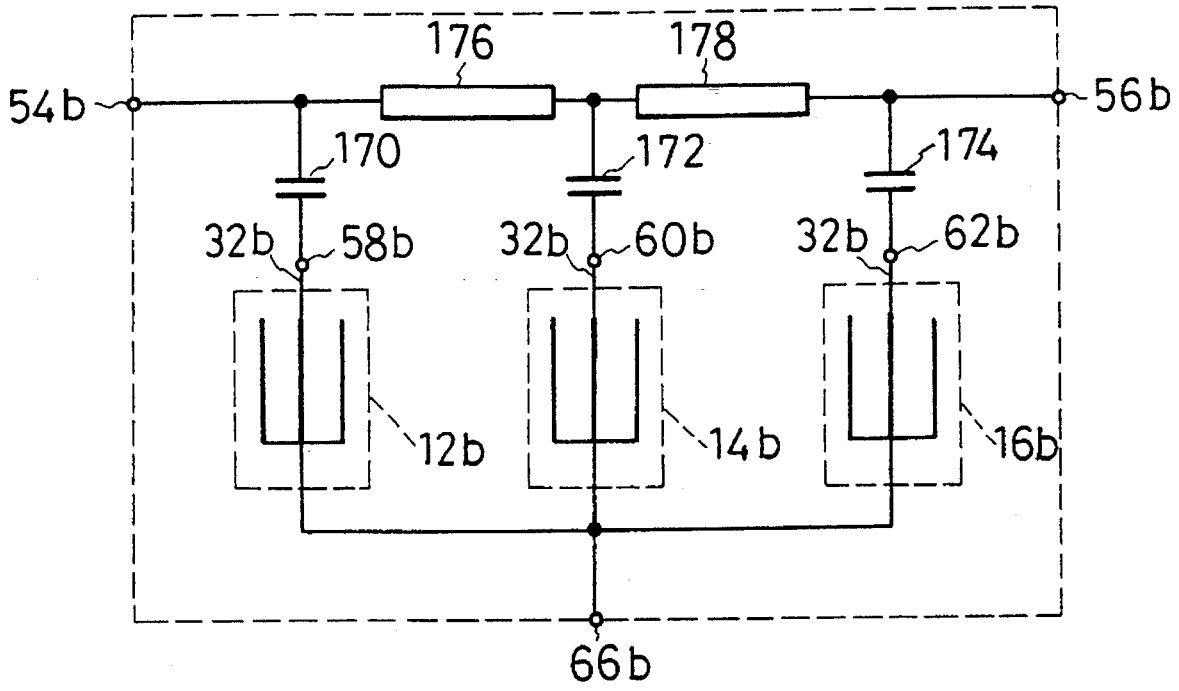
FIG. 15 is a schematic electrical diagram of the equivalent circuit of the FIG. 14 filter.

With reference to FIG. 15, which shows the equivalent circuit of the FIG. 14 filter 10*b*, the terminals 32*b* of the three dielectric resonators 12b–16b are connected to resonance capacitors 170, 172 and 174 via base terminals 58b, 60b and 62b, respectively. A 50-ohm strip transmission line 176 is connected between the capacitors 170 and 172, and another similar strip line 178 between the capacitors 172 and 174. The filter input terminal 54b is connected to both capacitor 170 and strip line 176, and the filter output terminal 56b to both capacitor 174 and strip line 178. The outer conductors 28b of all the resonators 12b–16b are connected to the grounding terminal 66b via the grounding conductor region 68b, FIG. 14, of the base structure 20b. The capacitors 170–174 and strip lines 176 and 178 are all embedded in the ceramic base plate 36b of the base structure 20b.

Figure 16:
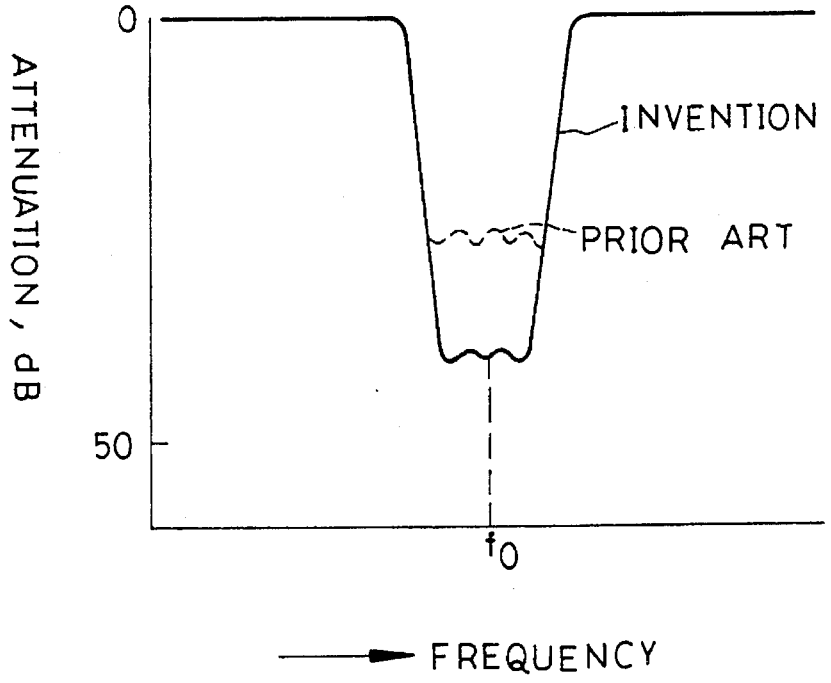
FIG. 16 is a graphic representation of the frequency characteristic of the FIG. 14 filter, shown in comparison with that of a comparable prior art filter.

FIG. 16 graphically represents by the solid line curve the frequency characteristic of the bandstop filter 10b of the foregoing construction. The dashed curve in the same graph represents the frequency characteristic of a comparable prior art filter in which all the dielectric resonators are oriented in the same direction. A comparison of the two curves clearly indicates that the prior art filter suffers signal leakage in the stop band having the central frequency $f_o$.

Fourth Form

Figure 17:
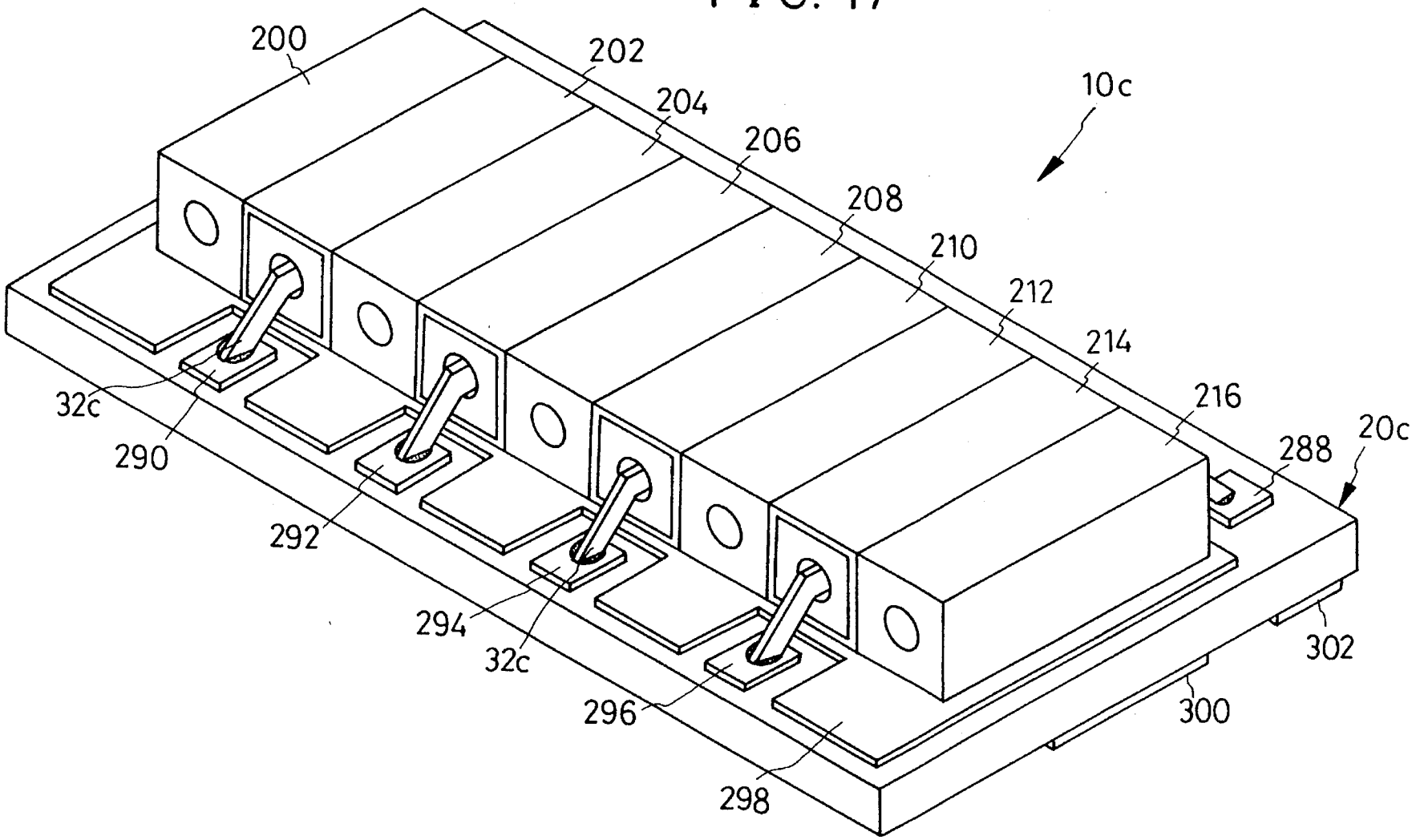
FIG. 17 is a perspective view of a duplex filter constructed in accordance wit the novel concepts of the invention.
Figure 18:
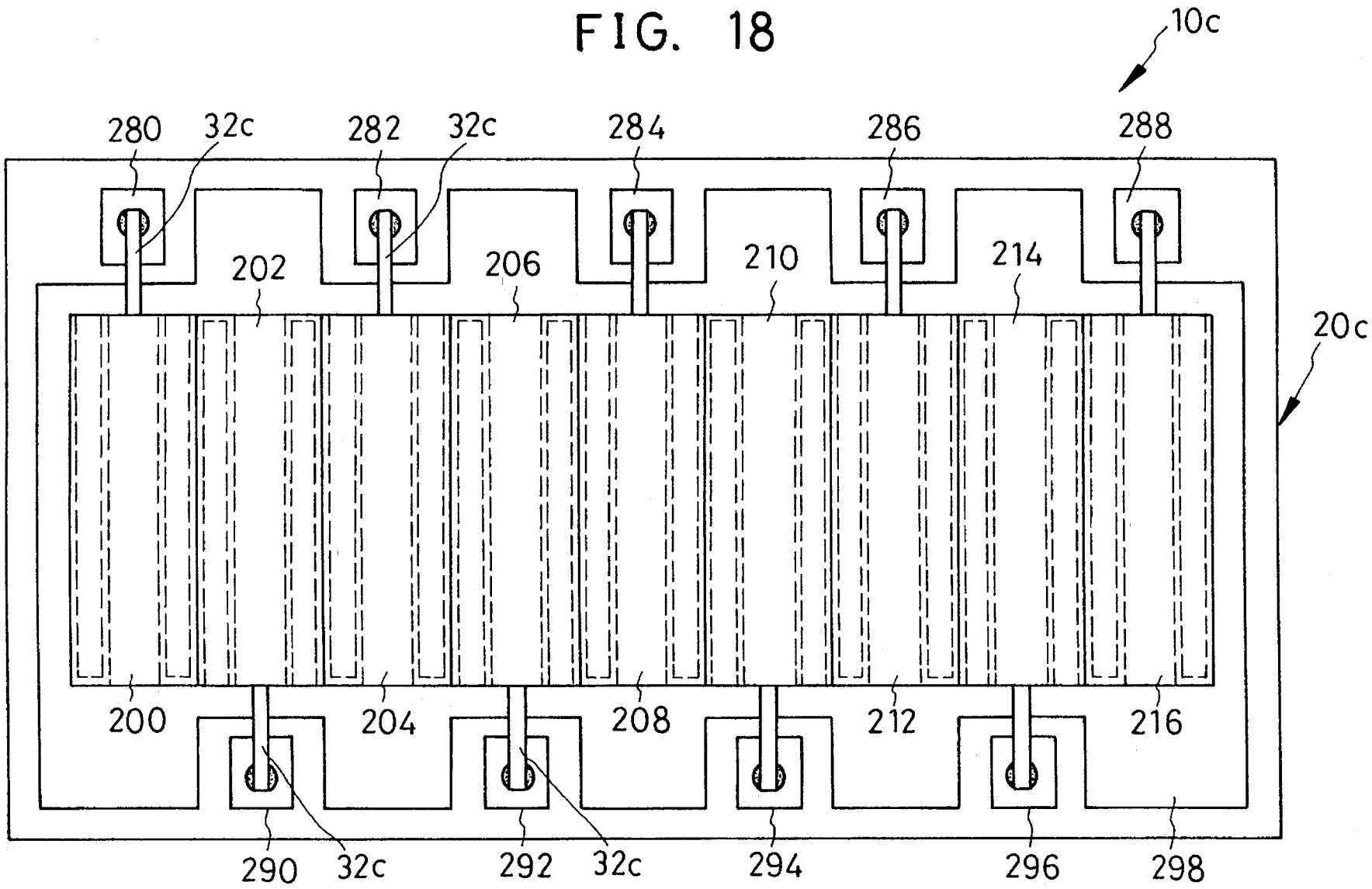
FIG. 18 is a top plan of the FIG. 17 filter.

Illustrated in FIGS. 17 and 18 is an adaptation of the invention for use as a duplexer, that is, a filter system that serves for both transmitting and receiving. The two-way filter system 10c is shown to have nine dielectric resonators 200, 202, 204, 206, 208, 210, 212, 214 and 216 mounted in close juxtaposition and in alternately opposite directions on a base structure 20c The resonators 200–216 are all identical in construction with the resonators 12–18 of the FIGS. 1–8 filter 10.

Figure 19:
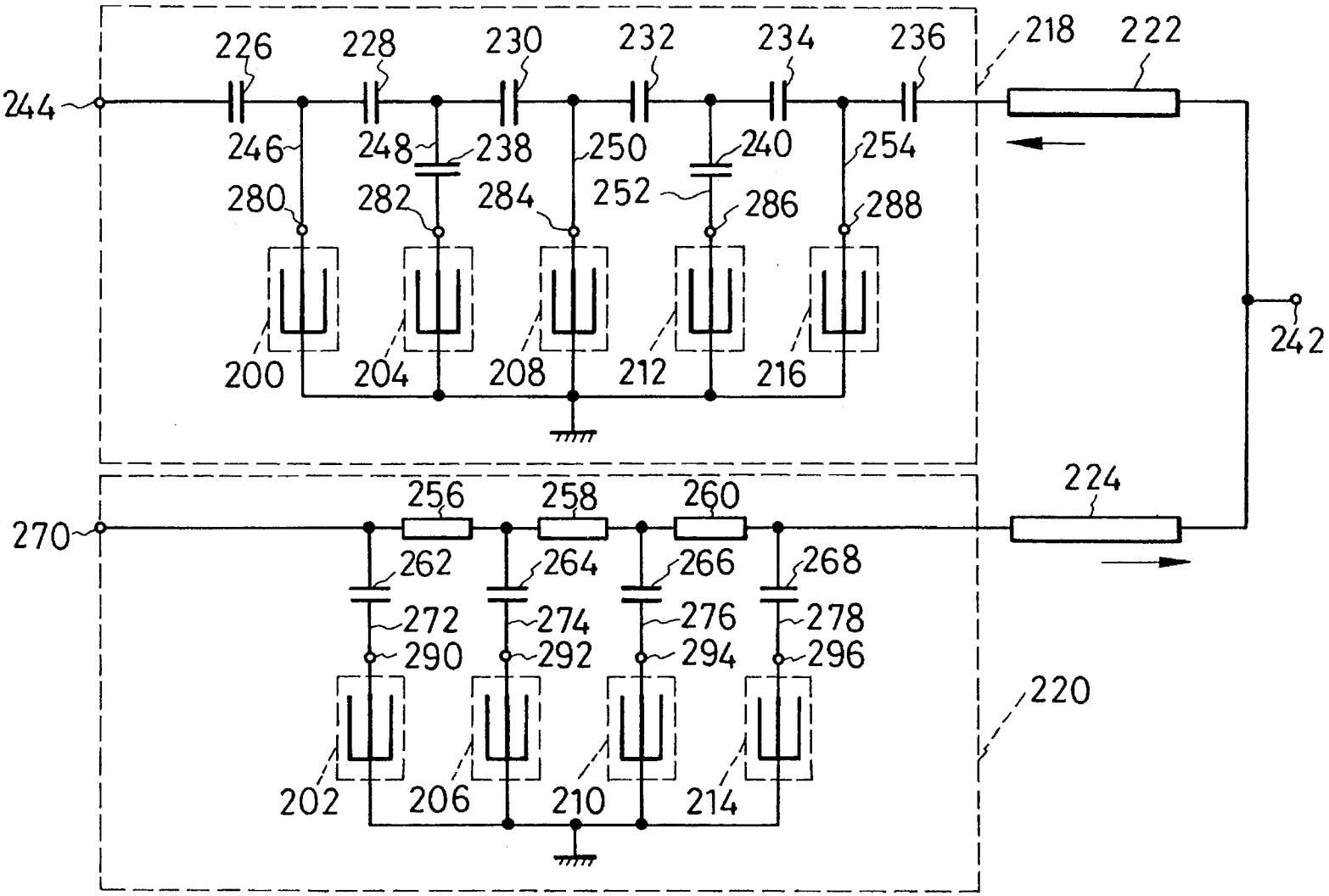
FIG. 19 is a schematic electrical diagram of the FIG. 17 filter.

The construction of the two-way filter system 10c will be better understood by first studying its equivalent circuit shown in FIG. 19. Essentially, the filter system 10c comprises a receiving filter circuit 218, a transmitting filter circuit 220, and two strip transmission lines 222 and 224 for coupling the circuits 218 and 220 together. The receiving filter circuit 218 comprises the first 200, third 204, fifth 208, seventh 212 and ninth 216 dielectric resonators, and eight capacitors 226, 228, 230, 232, 234, 236, 238 and 240. The capacitors 226–236 are connected in series between an antenna terminal 242 and the output terminal 244 of the receiving filter circuit 218. The resonators 200, 204, 208, 212 and 216 are connected between ground and lines 246, 248, 250, 252 and 254 branching off from between the capacitors 226–236. The capacitors 238 and 240 are inserted in the branch lines 248 and 252 and so connected in series with the resonators 204 and 212.

The transmitting filter circuit 220 comprises the second 202, fourth 206, sixth 210 and eighth 214 dielectric resonators, three strip transmission lines 256, 258 and 260, and four capacitors 262, 264, 266 and 268. The strip lines 256–260 are connected in series between the antenna terminal 242 and the input terminal 270 of the transmitting filter circuit 220. The resonators 202, 206, 210 and 214 are connected between ground and lines 272, 274, 276 and 278 branching off from between the strip lines 256–260, antenna terminal 242 and input terminal 270. The capacitors 262–268 are inserted in the respective branch lines 272–278.

The capacitors 226–240 and 262–268 and strip lines 222, 224 and 256–260 shown in FIG. 19 are all embedded in the base structure 20c of FIGS. 17 and 18 in a manner similar to that set forth in connection with the FIGS. 1–8 filter 10. Also, as in the filter 10, the terminals 32c of the resonators 200–216 are all soldered to base terminal conductor regions 280, 282, 284, 286, 288, 290, 292, 294 and 296 on the top of the base structure 20c. The outer conductors of the resonators 200–216 all make direct contact with a grounding conductor region 298 on the top of the base structure 20c, which region is electrically connected in turn to another grounding conductor region 300 on the bottom of the base structure 20c. Also formed on the bottom of the base structure 20c are an antenna terminal conductor region 302, a receiving circuit output terminal conductor region, not shown, and a transmitting circuit input terminal conductor region, also not shown.

A reconsideration of FIGS. 17 and 18 in light of FIG. 19 will reveal that the resonators 200, 204, 208, 212 and 216 of the receiving circuit 218 are all oriented in one direction and arranged alternately with the resonators 202, 206, 210 and 214 of the transmitting circuit 220 which are all oriented in the opposite direction. Consequently, as best seen in FIG. 18, the terminals 32c of the receiving circuit resonators 200, 204, 208, 212 and 216, and the associated base terminals 280–288, are all disposed on one side of the resonators 200–216, and the terminals 32c of the transmitting circuit resonators 202, 206, 210 and 214, and the associated base terminals 290–296, are all disposed on the other side of the resonators 200–216. The receiving circuit resonators 200, 204, 208, 212 and 216 and the transmitting circuit resonators 202, 206, 210 and 214 are therefore well electrically isolated from one another. The resonators of each circuit are also well isolated from one another because they alternate with the resonators of the other circuit.

Fifth Form

Figure 20:
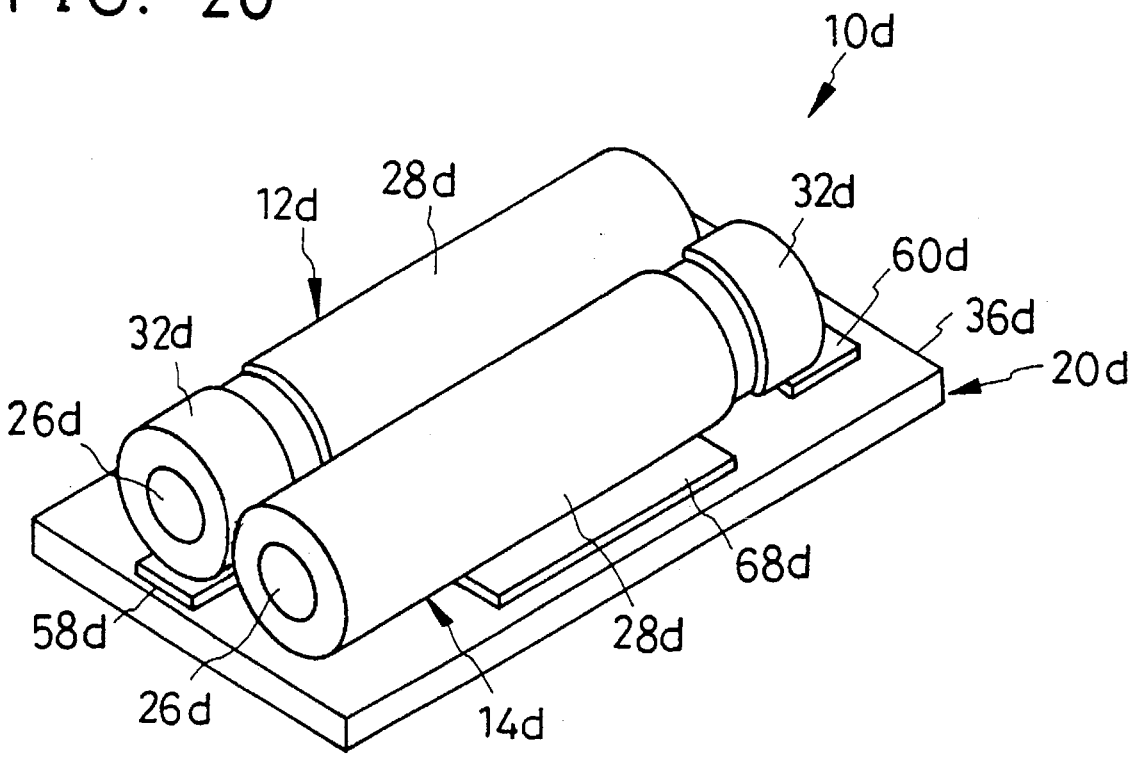
FIG. 20 is a perspective view of a dual filter system constructed in accordance with the novel concepts of the invention.

FIG. 20 shows an adaptation of the invention for a dual filter system 10d, that is, a system comprising two filters operating independently. The dual filter system 10d comprises two dielectric resonators 12d and 14d closely juxtaposed and oriented in opposite longitudinal directions on a base structure 20d. The resonators 12d and 14d are identical in construction with the resonators 12a and 14a of the FIGS. 9–13 filter 10a, each comprising an inner conductor 26d, an outer conductor 28d and a terminal conductor 32d.

Figure 21:
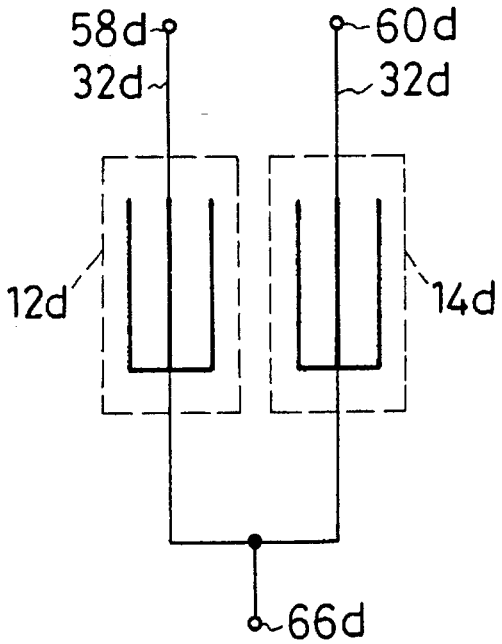
FIG. 21 is a schematic electrical diagram of the FIG. 20 filer system.

As will be understood from the equivalent circuit of the dual filter system 10d shown in FIG. 21, the terminal conductors 32d of the resonators 12d and 14d are connected to base terminals 58d and 60d, respectively, of the base structure 20d. The outer conductors of the resonators 12d and 14d are both connected to a grounding terminal 66d. Unlike the resonators 12a and 14a of the FIGS. 9–13 filter 10a, the resonators 12d and 14d are not capacitively coupled together, so that they function as independent filters.

With reference back to FIG. 20 the base plate 36d of the base structure 20d has formed on its top surface a grounding conductor region 68d and two base terminal conductor regions 58d and 60d. The outer conductors 28d of both resonators 12d and 14d are soldered to the grounding conductor region 68d, and their terminal conductors 32d to the respective base terminal conductor regions 58d and 60d. It is understood that the base plate 36d has formed on its bottom surface input and output terminal conductor regions and a grounding terminal conductor region, not shown, which are similar to those shown at 54, 56 and 66 in FIG. 6 and at 54a, 56a and 66a in FIGS. 9, 11 and 12.

It will be appreciated that, in this embodiment, signal leakage between the two filter units are reduced to a minimum by virtue of the arrangement of the two dielectric resonators 12d and 14d in opposite directions.

Notwithstanding the foregoing detailed disclosure, it is not desired that the invention be limited by the exact details of the illustrated embodiment. For example, printed circuit boards may be employed in lieu of laminated ceramic plates. It will also be apparent that some features of the illustrated embodiments are interchangeable. A variety of other modifications, alterations, substitutions and adaptations may be resorted to without departure from the fair meaning or proper scope of the claims attached hereto.

What is claimed is:

1. A wave filter apparatus comprising:

(a) a base structure comprising:

(i) a base plate having a pair of surfaces which are disposed opposite each other;

(ii) at least two base terminal conductor regions disposed at one of the surfaces of the base plate;

(iii) a grounding conductor region disposed at said one surface of the base plate; and (iv) a resonator coupling element electrically connected between the base terminal conductor regions, the resonator coupling element being embedded in the base plate, at least a part of the resonator coupling element being disposed under the grounding conductor region; and (b) at least two dielectric resonators mounted to the base structure, each dielectric resonator comprising:

(i) a dielectric body substantially in the shape of an elongate tube;

(ii) an inner conductor disposed on an inside surface of the dielectric body;

(iii) an outer conductor disposed on an outside surface of the dielectric body and electrically connected to the grounding conductor region of the base structure;

(iv) a shorting conductor disposed on a first end of the dielectric body for electrically interconnecting the inner and the outer conductors; and (v) a terminal disposed on a second end of the dielectric body and electrically connected to the inner conductor and to a respective one of the base terminal conductor regions of the base structure, wherein the resonator coupling element is disposed in parallel to at least one of the dielectric resonators.

2. The wave filter apparatus of claim 1 wherein the base structure further comprises:

(a) a filter input terminal conductor region;

(b) a filter output terminal conductor region;

(c) an input coupling element connected between the filter input terminal conductor region and one of the base terminal conductor regions, the input coupling element being embedded in the base plate; and (d) an output coupling element connected between the filter output terminal conductor region and the other of the base terminal conductor regions, the output coupling element also being embedded in the base plate.

3. The wave filter apparatus of claim 2 wherein the base plate of the base structure is comprised of ceramic material and wherein the input and the output coupling elements are each a capacitor comprising a respective pair of capacitor conductor regions embedded in the base plate.

4. The wave filter apparatus of claim 1 wherein the resonator coupling element is a strip transmission line.

5. The wave filter apparatus of claim 4 wherein the base structure further comprises:

(a) a first capacitor connected between the strip transmission line and one of the base terminal conductor regions, the first capacitor being embedded in the base plate; and (b) a second capacitor connected between the strip transmission line and the other of the base terminal conductor regions, the second capacitor also being embedded in the base plate.

6. The wave filter apparatus of claim 1 wherein the terminal of each respective dielectric resonator projects from the second end of the corresponding dielectric body in a direction away from the first end thereof.

7. The wave filter apparatus of claim 1 wherein the base plate of the base structure is comprised of ceramic material, and wherein the resonator coupling element is a capacitor comprising a pair of capacitor conductor regions embedded in the base plate.

8. A wave filter apparatus comprising:

(a) a base structure comprising:

(i) a base plate having a pair of surfaces which are disposed opposite each other;

(ii) at least two base terminal conductor regions disposed on one of the surfaces of the base plate;

(iii) a first grounding conductor region disposed on said one surface of the base plate;

(iv) a second grounding conductor region disposed on the other of the second surfaces of the base plate and connected to the first grounding conductor region; and (v) a resonator coupling element electrically connected between the base terminal conductor regions, the resonator coupling element being embedded in the base plate; and (b) at least two dielectric resonators mounted to the base structure, each dielectric resonator comprising:

(i) a dielectric body substantially in the shape of an elongate tube;

(ii) an inner conductor disposed on an inside surface of the dielectric body;

(iii) an outer conductor disposed on an outside surface of the dielectric body and electrically connected to the first grounding conductor region of the base structure;

(iv) a shorting conductor disposed on a first end of the dielectric body for electrically interconnecting the inner and the outer conductors; and (v) a terminal disposed on a second end of the dielectric body and electrically connected to the inner conductor and to a respective one of the base terminal conductor regions of the base structure, wherein at least a part of the resonator coupling element is disposed between the outer conductor of at least one of the dielectric resonators and the second grounding conductor region, and wherein the resonator coupling element is disposed in parallel to at least one of the dielectric resonators.

9. The wave filter apparatus of claim 8 wherein the base structure further comprises:

(a) a filter input terminal conductor region;

(b) a filter output terminal conductor region;

(c) an input coupling element connected between the filter input terminal conductor region and one of the base terminal conductor regions, the input coupling element being embedded in the base plate; and (d) an output coupling element connected between the filter output terminal conductor region and the other of the base terminal conductor regions, the output coupling element also being embedded in the base plate.

10. The wave filter apparatus of claim 9 wherein the base plate of the base structure is comprised of ceramic material and wherein the input and the output coupling elements are each a capacitor comprising a respective pair of capacitor conductor regions embedded in the base plate.

11. The wave filter apparatus of claim 8 wherein the resonator coupling element is a strip transmission line.

12. The wave filter apparatus of claim 11 wherein the base structure further comprises:

(a) a first capacitor connected between the strip transmission line and one of the base terminal conductor regions, the first capacitor being embedded in the base plate; and (b) a second capacitor connected between the strip transmission line and the other of the base terminal conductor regions, the second capacitor also being embedded in the base plate.

13. The wave filter apparatus of claim 8 wherein the terminal of each respective dielectric resonator projects from the second end of the corresponding dielectric body in a direction away from the first end thereof.

14. The wave filter apparatus of claim 8 wherein the base plate of the base structure is comprised of ceramic material, and wherein the resonator coupling element is a capacitor comprising a pair of capacitor conductor regions embedded in the base plate.

15. A wave filter apparatus comprising:

(a) a base structure comprising:

(i) a base plate having a pair of surfaces which are disposed opposite each other;

(ii) at least two base terminal conductor regions disposed at one of the surfaces of the base plate;

(iii) a first grounding conductor region disposed at said one surface of the base plate;

(iv) a second grounding conductor region disposed at the other of the surfaces of the base plate and connected to the first grounding conductor region;

(v) a resonator coupling element electrically connected between the base terminal conductor regions;

(vi) a filter input terminal conductor region;

(vii) a filter output terminal conductor region;

(viii) an input coupling element connected between the filter input terminal conductor region and one of the base terminal conductor regions, the input coupling element being embedded in the base plate, at least a part of the input coupling element being disposed between the first and the second grounding conductor regions; and (ix) an output coupling element connected between the filter output terminal conductor region and the other of the base terminal conductor regions, the output coupling element also being embedded in the base plate, at least a part of the output coupling element being disposed between the first and the second grounding conductor regions; and (b) at least two dielectric resonators mounted to the base structure, each dielectric resonator comprising:

(i) a dielectric body substantially in the shape of an elongate tube;

(ii) an inner conductor disposed on an inside surface of the dielectric body;

(iii) an outer conductor disposed on an outside surface of the dielectric body and electrically connected to the first grounding conductor region of the base structure;

(iv) a shorting conductor disposed on a first end of the dielectric body for electrically interconnecting the inner and the outer conductors; and (v) a terminal disposed on a second end of the dielectric body and electrically connected to the inner conductor and to a respective one of the base terminal conductor regions of the base structure.

16. The wave filter apparatus of claim 15 wherein the resonator coupling element is a strip transmission line.

17. The wave filter apparatus of claim 16 wherein the base structure further comprises:

(a) a first capacitor connected between the strip transmission line and one of the base terminal conductor regions, the first capacitor being embedded in the base plate; and (b) a second capacitor connected between the strip transmission line and the other of the base terminal conductor regions, the second capacitor also being embedded in the base plate.

18. The wave filter apparatus of claim 15 wherein the base plate of the base structure is comprised of ceramic material, and wherein the resonator coupling element is a capacitor comprising a pair of capacitor conductor regions.

19. The wave filter apparatus of claim 15 wherein the base plate of the base structure is comprised of ceramic material and wherein the input and the output coupling elements are each a capacitor comprising a respective pair of capacitor conductor regions embedded in the base plate.

20. The wave filter of claim 15 wherein the terminal of each respective dielectric resonator projects from the second end of the corresponding dielectric body in a direction away from the first end thereof.

21. A wave filter apparatus comprising:

(a) a base structure comprising:

(i) a base plate having a pair of surfaces which are disposed opposite each other;

(ii) at least two base terminal conductor regions disposed at one of the surfaces of the base plate;

(iii) a first grounding conductor region disposed at said one surface of the base plate;

(iv) a second grounding conductor region disposed at the other of the second surfaces of the base plate and connected to the first grounding conductor region; and (v) a resonator coupling element electrically connected between the base terminal conductor regions, the resonator coupling element being embedded in the base plate, at least a part of the resonator coupling element being disposed between the first and the second grounding conductor regions; and (b) at least two dielectric resonators mounted to the base structure, each dielectric resonator comprising:

(i) a dielectric body substantially in the shape of an elongate tube;

(ii) an inner conductor disposed on an inside surface of the dielectric body;

(iii) an outer conductor disposed on an outside surface of the dielectric body and electrically connected to the first grounding conductor region of the base structure;

(iv) a shorting conductor disposed on a first end of the dielectric body for electrically interconnecting the inner and the outer conductors; and (v) a terminal disposed on a second end of the dielectric body and electrically connected to the inner conductor and to a respective one of the base terminal conductor regions of the base structure.

22. The wave filter apparatus of claim 21 wherein the resonator coupling element is a strip transmission line.

23. The wave filter apparatus of claim 22 wherein the base structure further comprises:

(a) a first capacitor connected between the strip transmission line and one of the base terminal conductor regions, the first capacitor being embedded in the base plate; and (b) a second capacitor connected between the strip transmission line and the other of the base terminal conductor regions, the second capacitor also being embedded in the base plate.

24. The wave filter apparatus of claim 21 wherein the base plate of the base structure is comprised of ceramic material, and wherein the resonator coupling element is a capacitor comprising a pair of capacitor conductor regions embedded in the base plate.

25. The wave filter apparatus of claim 21 wherein the base structure further comprises:

(a) a filter input terminal conductor region;

(b) a filter output terminal conductor region;

(c) an input coupling element connected between the filter input terminal conductor region and one of the base terminal conductor regions, the input coupling element being embedded in the base plate; and (d) an output coupling element connected between the filter output terminal conductor region and the other of the base terminal conductor regions, the output coupling element also being embedded in the base plate.

26. The wave filter apparatus of claim 25 wherein the base plate of the base structure is comprised of ceramic material and wherein the input and the output coupling elements are each a capacitor comprising a respective pair of capacitor conductor regions embedded in the base plate.

27. The wave filter apparatus of claim 21 wherein the terminal of each respective dielectric resonator projects from the second end of the corresponding dielectric body in a direction away from the first end thereof.

* * * * *